US012012683B2

(12) United States Patent
Demange et al.

(10) Patent No.: US 12,012,683 B2
(45) Date of Patent: Jun. 18, 2024

(54) NEEDLE LOOM FOR CONSOLIDATING A WEB OR LAP OF FIBRES, PARTICULARLY NONWOVEN, ASSEMBLY COMPRISING A WEB OR LAP OF FIBRES AND A NEEDLE LOOM OF THIS TYPE AND METHOD FOR OPERATING A NEEDLE LOOM OR AN ASSEMBLY OF THIS TYPE

(71) Applicant: Andritz Asselin-Thibeau, Elbeuf (FR)

(72) Inventors: Frédéric Demange, Montville (FR); Jean-Christophe Laune, La Londe (FR)

(73) Assignee: Andritz Asselin-Thibeau, Elbeuf (FR)

( * ) Notice: Subject to any disclaimer, the term of this patent is extended or adjusted under 35 U.S.C. 154(b) by 78 days.

(21) Appl. No.: 17/879,864

(22) Filed: Aug. 3, 2022

(65) Prior Publication Data

US 2023/0042283 A1 Feb. 9, 2023

(30) Foreign Application Priority Data

Aug. 3, 2021 (FR) ..... 21 08439

(51) Int. Cl.
*D04H 18/02* (2012.01)

(52) U.S. Cl.
CPC ..... *D04H 18/02* (2013.01)

(58) Field of Classification Search
CPC ..... D04H 18/02; D04H 1/46; D04H 3/105; D04H 3/102; D04H 5/02; D04H 13/005; D04H 18/00
See application file for complete search history.

(56) References Cited

U.S. PATENT DOCUMENTS 5,636,420 A * 6/1997 Jourde ..... H02P 5/50 28/107
6,161,269 A * 12/2000 Dilo ..... D04H 18/02 28/107

(Continued)

FOREIGN PATENT DOCUMENTS

| | | |
|---|---|---|
| EP | 1927692 A1 | 6/2008 |
| EP | 1943382 B1 | 4/2018 |
| GB | 2310221 A | 8/1997 |

OTHER PUBLICATIONS

English language translation of EP 1927692 (Chadelas et al.) Doc Pub Jun. 2008.*
Search Report for EP 21 08439 dated Apr. 20, 2022.

*Primary Examiner* — Amy Vanatta
(74) *Attorney, Agent, or Firm* — Renner, Kenner, Greive, Bobak, Taylor & Weber

(57) ABSTRACT

Method for operating a needle loom comprising at least one needle board in which a web or lap of fibres is passed in front of the needles, said web or fibre moving in a so-called feed direction, or machine direction or MD, between two end positions in which the free ends of the needles have a zero speed, and the at least one needle board and/or needles are driven in a back-and-forth movement in a direction other than the feed direction, particularly in the perpendicular direction, or a direction that is substantially perpendicular to the plane of the lap or web, such that the free ends of the needles have, in a first interval extending in the lap or web between an outer surface of the web or lap of fibres and an end position, a first movement having a first speed profile as an absolute value for a first duration, then, in a second interval extending in the lap or web between said one end position and said one outer surface, a second movement having a second speed profile as an absolute value for a second duration, is characterised in that the maximum speed (Continued)

of the second profile is higher than the maximum speed of the first profile and/or the second duration is shorter than the first duration.

20 Claims, 10 Drawing Sheets

(56) References Cited

U.S. PATENT DOCUMENTS

| | | | | |
|---|---|---|---|---|
| 9,388,518 | B2 | 7/2016 | Kuhl | |
| 2002/0133923 | A1* | 9/2002 | Duval | D04H 18/02 28/107 |
| 2003/0074773 | A1* | 4/2003 | Legl | D04H 1/46 28/107 |
| 2005/0217093 | A1* | 10/2005 | Muller | D04H 18/02 28/107 |
| 2006/0288548 | A1 | 12/2006 | Jean et al. | |
| 2007/0006432 | A1* | 1/2007 | Noel | D04H 18/02 28/107 |
| 2015/0259836 | A1* | 9/2015 | Dilo | D04H 18/02 28/111 |

* cited by examiner

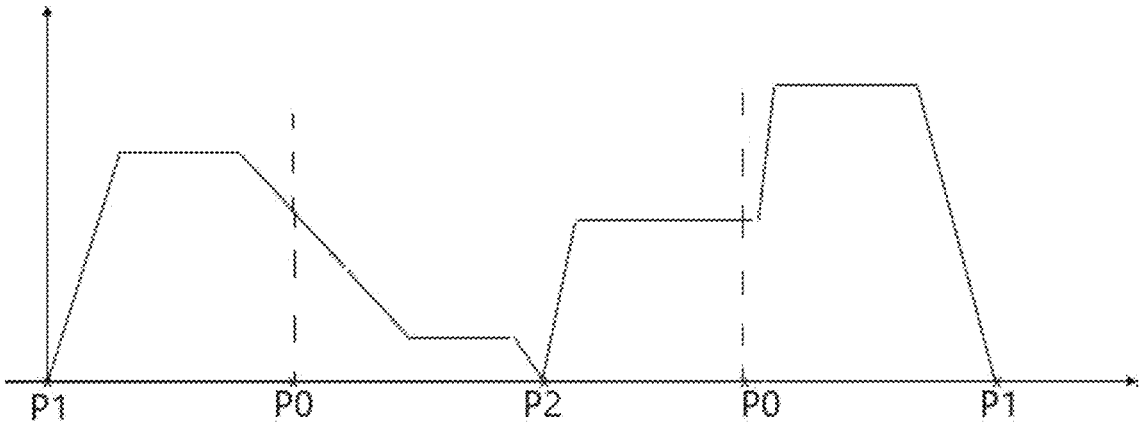
[Fig. 7]

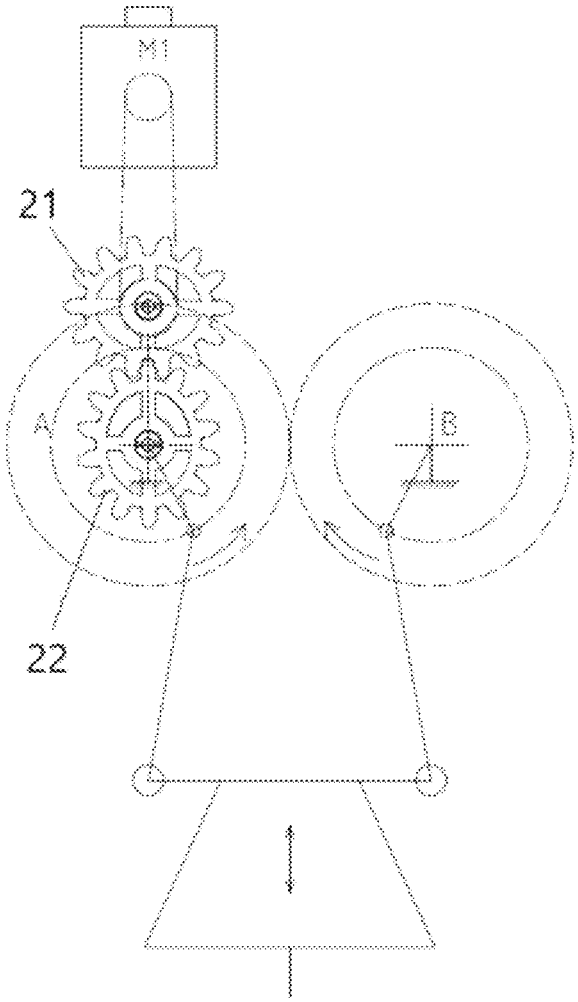
[Fig. 8]

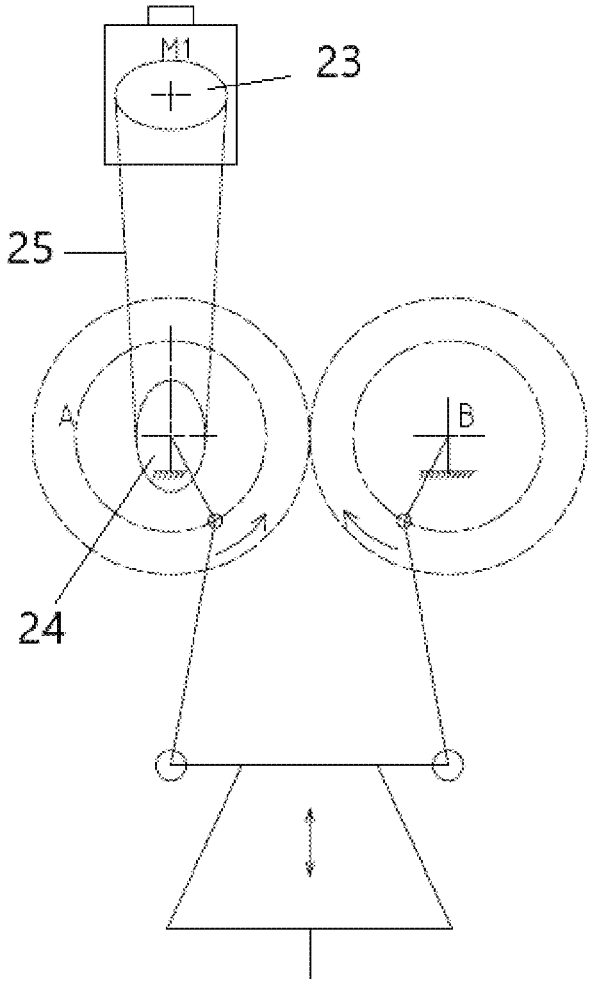
[Fig. 9]

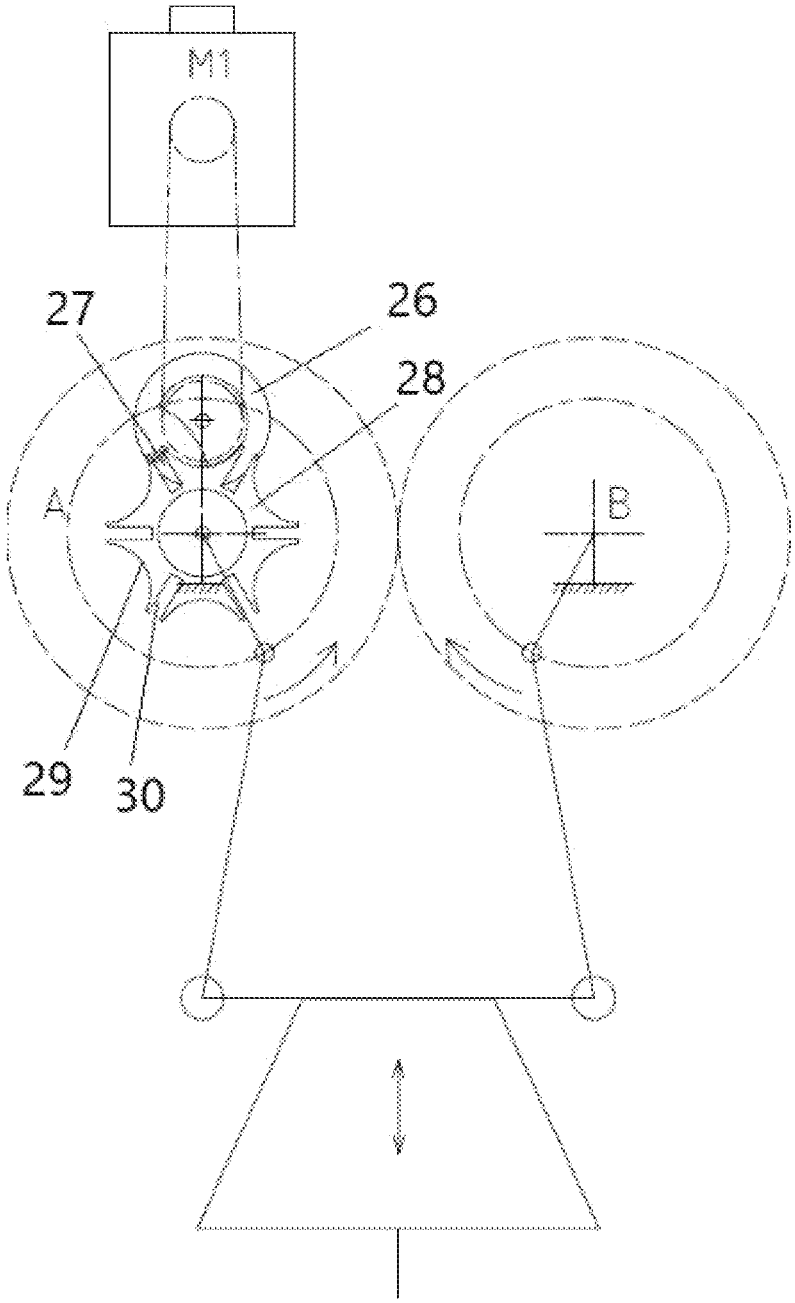
[Fig. 10]

NEEDLE LOOM FOR CONSOLIDATING A WEB OR LAP OF FIBRES, PARTICULARLY NONWOVEN, ASSEMBLY COMPRISING A WEB OR LAP OF FIBRES AND A NEEDLE LOOM OF THIS TYPE AND METHOD FOR OPERATING A NEEDLE LOOM OR AN ASSEMBLY OF THIS TYPE

TECHNICAL FIELD OF INVENTION

The present invention relates to a needle loom for consolidating a web or lap of fibres, particularly nonwoven, comprising at least one needle board, in front of which the web or lap of fibres passes by moving in a so-called feed direction, or machine direction or MD, and drive means configured to impart a back-and-forth movement to the at least one needle board and/or to the needles in a direction other than the feed direction, particularly in the perpendicular direction, or a direction that is substantially perpendicular to the plane of the lap or web, such that the needles are inserted in the lap or web in one direction, then, in another direction, are extracted from the lap or web of fibres, and a method for operating a needle loom of this type.

BACKGROUND OF THE INVENTION

EP1927692A1 in the applicant's name already discloses an assembly forming a needle loom comprising a fibre lap that moves in a so-called feed direction, or machine direction or MD, and a needle loom comprising a needle board having a field of needles arranged such as to penetrate the fibre lap moving in front of the needles, said needle loom comprising drive means configured such as to induce a back-and-forth movement of the needles, in a displacement interval of the free ends of the needles between two top and bottom end positions where the free ends of the needles have a speed whose component perpendicular to the plane of the lap, called vertical component of the speed, is zero, wherein the needles, during a first interval, penetrate into the lap with a first profile of speed vertical components in absolute values and, during a second interval, exit from the lap with a second profile of speed vertical components in absolute values, the maximum speed vertical component in absolute value of the first profile being equal to the one of the second profile, and the needles spending the same amount of time in the lap during their movement towards the bottom as during their movement towards the top, the trajectory covered by the needles from the top end position to the bottom end position being elliptical in shape with its main axis inclined with respect to the vertical and the needles comprising barbs which, in the first interval, become attached to the fibres and move said fibres such that they become enmeshed with the other fibres, thus achieving consolidation, and, in the second interval, do not become attached to the fibres This type of assembly has a complex design and the barbs are not sufficiently hooked to the lap due to the inclination, which has an adverse effect on the consolidation quality.

The aim is to improve known needle looms, particularly increasing their production rate without adversely affecting the quality of the web or lap leaving the needle loom or, while maintaining the same production rate, improving the quality of the web or lap leaving the needle loom.

SUMMARY OF THE INVENTION

According to one of its features, the present invention relates to an assembly forming a needle loom comprising a web or lap of fibres, particularly nonwoven, that moves in a so-called feed direction, or machine direction or MD, and a needle loom comprising one or more needle board(s) having a field of needles or respective field of needles arranged such as to pass into the web or lap of fibres, particularly nonwoven, moving in front of the needles, said needle loom comprising drive means configured such as to induce a back-and-forth movement of the needles, in a displacement interval of the free ends of the needles between two top and bottom end positions where the free ends of the needles have a speed whose component perpendicular to the plane of the web or lap, called vertical component of the speed, is zero, particularly a speed that is zero, such that the free ends of the needles have, in a first interval extending in the lap or web between an outer surface of the web or lap of fibres and an end position, a first movement having a first profile of speed vertical components in absolute value for a first duration, then, in a second interval extending in the lap or web between said one end position and said one outer surface, a second movement having a second profile of speed vertical components in absolute value for a second duration, and the needles comprising barbs which, in the first interval, become hooked to the fibres and move said fibres such that they become enmeshed with the other fibres, thus achieving consolidation, and, in the second interval, do not become hooked to the fibres, is characterised in that:

- the maximum speed vertical component in absolute value of the second profile is higher than the maximum speed vertical component in absolute value of the first profile and/or the second duration is shorter than the first duration.

The present invention also relates to a method for operating a needle loom comprising at least one needle board in which:

- a web or lap of fibres is passed in front of the needles, said web or lap of fibres moving in a so-called feed direction, or machine direction or MD, and
- said at least one needle board and/or the needles are driven in a back-and-forth movement in a direction other than the feed direction, particularly in the perpendicular direction, called the vertical direction, or a direction that is substantially perpendicular to the plane of the lap or web, such that the free ends of the needles have, in a first interval extending in the lap or web between an outer surface of the web or lap of fibres and an end position, a first movement having a first profile of vertical components of the speed in absolute value for a first duration, then, in a second interval extending in the lap or web between said one end position and said one outer surface, a second movement having a second profile of vertical components of the speed in absolute value for a second duration, is characterised in that:
- the maximum speed vertical component in absolute value of the second profile is higher than the maximum speed vertical component in absolute value of the first profile and/or the second duration is shorter than the first duration.

According to another feature of the invention, which constitutes an invention in its own right independently of the preceding features of the invention, but which may favourably be employed in combination with said features, the free ends of the needles have, in a third interval, or preliminary interval, extending outside the lap or web between the other end position and said outer surface of the web or lap, a third movement having a third profile of vertical components of the speed in absolute value for a third duration, and, in a fourth interval, or subsequent interval, extending outside the lap or web between said outer surface and said other end position, a fourth movement having a fourth profile of vertical components of the speed in absolute value for a fourth duration, and the maximum speed vertical component in absolute value of the first profile is less than at least one of the maximum speed vertical components in absolute value of the third and fourth profiles, particularly each of these, and/or the first duration is longer than at least one of the third and fourth durations, particularly each of these.

Preferably, the maximum speed vertical component in absolute value of the second profile is less than at least one of the maximum speed vertical components in absolute value of the third and fourth profiles, particularly each of these, and/or the second duration is longer than at least one of the third and fourth durations, particularly each of these.

According to yet another of its features, the present invention relates to a needle loom comprising one or more needle board(s) having a field of needles or respective field of needless arranged such as to penetrate a web or lap of fibres, particularly nonwoven, moving in a so-called feed direction, or machine direction or MD, in front of the needles, said needle loom comprising drive means configured such as to induce a back-and-forth movement of the needles, in a displacement interval of the free ends of the needles between two top and bottom end positions where the free ends of the needles have a zero speed vertical component, such that the free ends of the needles have, in a first outward interval extending between the median position and an end position, a first movement having a first outward profile of speed vertical components in absolute value for a first outward duration, then, in a second return interval extending between said one end position and said one median position, a second return movement having a second return profile of speed vertical components in absolute value for a second return duration, characterised in that:

the maximum speed vertical component in absolute value of the second return profile is different from the maximum speed vertical component in absolute value of the first return profile, and/or the second return duration is different from the first outward duration.

According to a feature that is independent of the above feature, which constitutes an invention in its own right independently of this feature, but which may favourably be employed in combination with said feature, the free ends of the needles have, in a third outward interval extending between the other end position and the median position, a third outward movement having a third profile of speed vertical components in absolute value for a third outward interval, and, in a fourth return interval extending between said median position and said other end position, a fourth return movement having a fourth profile of speed vertical components in absolute value for a fourth return duration, and the maximum speed vertical component in absolute value of the first profile is different from at least one of the maximum speed vertical components in absolute value of the third and fourth profiles, particularly each of these, and/or the first duration is different from at least one of the third and fourth durations, particularly each of these.

Preferably, the maximum speed vertical component in absolute value of the second profile is different from at least one of the maximum speed vertical components in absolute value of the third and fourth profiles, particularly each of these, and/or the second duration is different from at least one of the third and fourth durations, particularly each of these.

According to each of the different features of the invention, it is thus possible to achieve a higher production rate and/or a better quality of the consolidated web or lap.

This is because the needles comprise barbs which, when the needles are inserted in a web or lap of fibres, become attached to the fibres and cause said fibres to become enmeshed with the other fibres, thus achieving consolidation. The inventors of the present invention realised that moving the needles inside the web or lap too quickly, particularly in the direction in which the barbs are arranged to attach to the fibres, causes the barbs to cut the fibres rather than attaching to them, which has an adverse effect on consolidation quality.

At the same time, this effect is lessened when the needles are extracted from the web or lap such that it is also possible to move more quickly when going back up into the web or lap compared to going down. Therefore, with an identical cycle rate (upwards+downwards movement), it is possible to achieve a better quality or otherwise achieve a higher rate with the same quality.

Preferably, the drive means are configured such that the movement in the displacement interval in one direction between the two end positions in one direction, for example from top to bottom, takes place over a duration referred to as the insertion duration, and in that the movement in the displacement interval between the two end positions in the opposite direction, for example from bottom to top, takes place over a duration referred to as the extraction duration, and said insertion duration is longer than said extraction duration.

Preferably, said insertion duration ranges between 1.01 and 5.0 times said extraction duration, preferably between 1.05 and 3.0, even more preferably between 1.1 and 2.0.

Preferably, during said insertion duration, the needles reach a maximum insertion speed vertical component in absolute value, and, during said extraction duration, the needles reach a maximum extraction speed vertical component in absolute value, and the maximum extraction speed vertical component in absolute value is higher than the maximum insertion speed vertical component in absolute value.

Preferably, the maximum insertion speed vertical component in absolute value is reached when the free ends of the needles are outside the lap or web.

Preferably, the maximum extraction speed vertical component in absolute value is reached when the free ends of the needles are outside the lap or web.

According to a preferred embodiment, the drive means comprise at least one rotating element which, if rotated through 360°, corresponds to driving the needles over one back-and-forth cycle, and movement in the displacement interval in one direction between the two end positions, for example from top to bottom, of the needles takes place over a range extending between 0° and an angle of rotation RA that is strictly higher than 180°, and movement in the displacement interval between the two end positions in the opposite direction, for example from bottom to top, takes place over a range extending between the angle of rotation RA and 360°, in particular the angle of rotation RA being between 181° and 210°, particularly between 185° and 200°, preferably between 190° and 195°.

According to a preferred embodiment of the invention, over a back-and-forth cycle, particularly a 360° cycle, the speed vertical component in absolute value of the needle ends changes from zero to a maximum insertion value over a first initial insertion duration, then remains constant over a second insertion duration at a constant speed, then reduces to zero over a third end-of-insertion duration, then changes from zero to a maximum extraction value over a fourth initial extraction duration, then remains constant over a fifth extraction duration at constant speed, which is in particular shorter than the second insertion duration at constant speed, then reduces over a sixth end-of-extraction duration.

According to a favourable embodiment, the movement of the needles is a movement along a rectilinear trajectory, particularly perpendicular to the plane of the lap or web or vertical, particularly from bottom to top.

According to another equally favourable embodiment, the movement of the needles comprises a vertical component and a horizontal component and does not follow a rectilinear trajectory.

According to a first advantageous embodiment, the drive means comprise a crankshaft with a connecting rod which is hinged to a cam that drives a rod integral with the needles in a linear back-and-forth movement.

According to a further advantageous embodiment, the drive means comprise a crankshaft with a connecting rod which is hinged to a tie rod hinged to a rod integral with the needles, the axis of rotation of the crankshaft connecting rod being offset with respect to the back-and-forth direction of the rod that is integral with the needles.

According to another favourable embodiment, the web or lap of fibres, particularly nonwoven, has a thickness ranging between 5 and 70% of the range of travel of the ends of the needles between the two end points, particularly less than 60%, preferably less than 50%, particularly less than 40%.

In particular, the lap or web of fibres, particularly nonwoven, extends while being supported by a support table.

In particular, the lap or web extends between a support table and a stripper, and, in particular, the distance between the support table and the stripper corresponds substantially to the range of travel between the two end points.

BRIEF DESCRIPTION OF THE DRAWINGS

Embodiments of the invention are described below with reference to the drawings, which are given solely by way of example, in which:

FIG. 7 represents a graph showing the speed profiles as a function of the range of travel of the ends of the needles over a P1-P0-P2-P0-P1 cycle according to an embodiment of the invention; and FIGS. 8 to 10 are schematic representations of yet more embodiments of needle looms according to the invention.

DETAILED DESCRIPTION OF THE INVENTION

Figure 1:
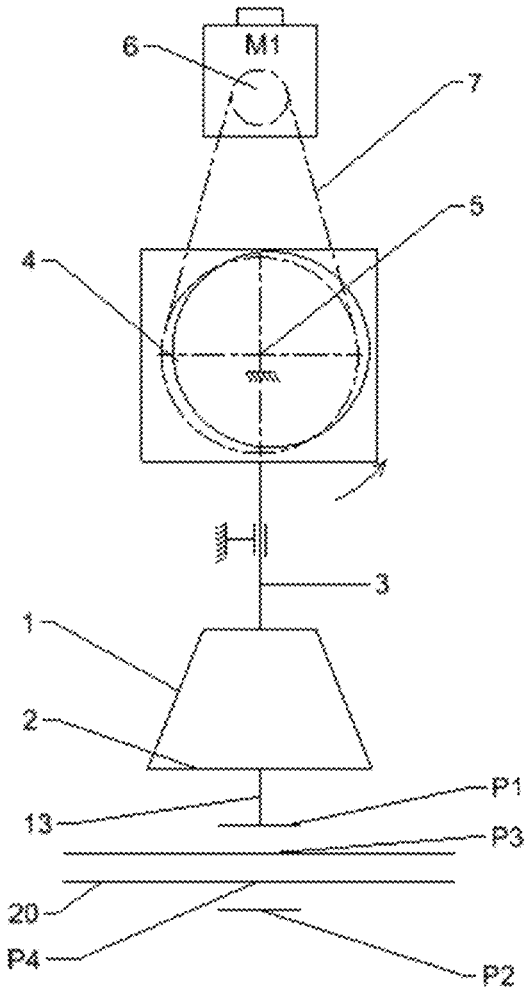
FIG. 1 is a schematic representation of a needle loom according to a first embodiment of the invention.

FIG. 1 shows a first embodiment of a needle loom according to the invention.

A needle beam 1 comprises, originating from its lower face 2, an area of needles 13 (just one needle is shown on the figure) which extend vertically. These needles are intended to pass downwards (insertion movement) through a web or lap 20 of fibres that moves in front of said needles from left to right on the figure, this direction being referred to as the machine direction or direction MD. In this case the direction MD is horizontal.

This beam 1 forms an integral part of the lower end of a vertical column 3 which is mounted such that it is hinged, at its other end, to a cam 4 mounted such that it rotates with respect to an axis 5 perpendicular to the plane of the figure (the axis extends in direction CD, perpendicular to direction MD and to the vertical direction).

The cam 4 is driven in rotation at a constant speed by the connecting rod 7 of a crankshaft 6 actuated by a motor M1.

The cam is, for example, circular in shape with its axis 5 of rotation offset with respect to the axis of the circle of the circular shape. However, the cam may assume other shapes, depending on the desired speed profile.

The range of travel of the ends of the needles passes between the upper P1 and lower P2 end points, said points being where the ends of the needles change direction and thus have a zero speed. The median point P0 is located halfway between the two points P1 and P2.

The lap or web to be consolidated extends between the two points P3 and P4 corresponding to the upper and lower outer surfaces of the web or the lap. In particular, it is possible to have point P4, which may be above the lower point P2 or below the lower point P2 or may be merged with said point.

The median point may be located outside the two points P3 and P4, or inside the two points P3 and P4, in particular strictly inside the interval [P3; P4].

In particular, a support table may be provided with an upper surface that corresponds to point P2 and a stripper pierced with holes through which the needles pass, and point P1 is preferably located above the stripper to ensure that any fibre carried along by the needle when it moves back up is blocked by the stripper and remains below said stripper.

Figure 3:
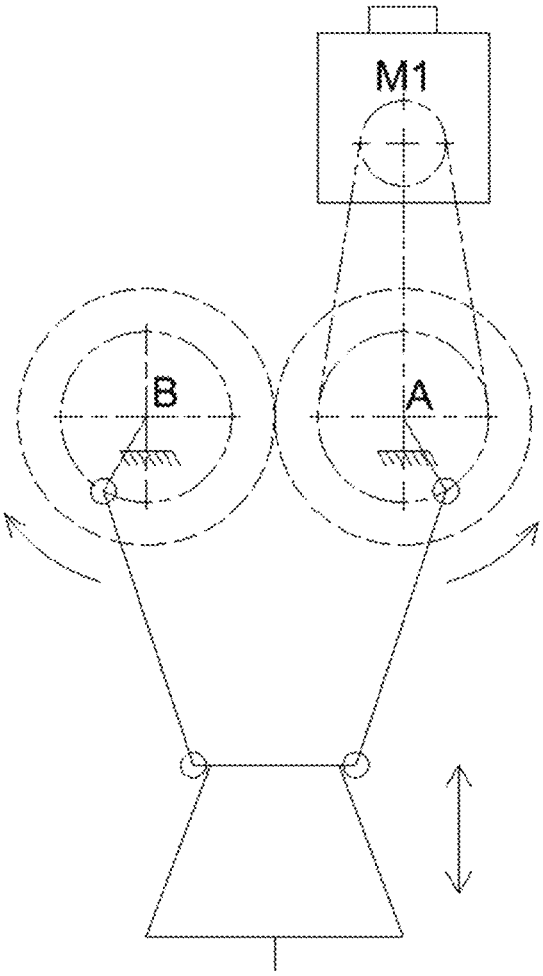
FIG. 3 is a schematic representation of a needle loom according to yet another embodiment of the invention.

According to another embodiment shown in FIG. 8, two oval or elliptical transmission gears 21, 22 may be provided between the motor M1 and at least one of the connecting rods of the module in FIG. 3, said eccentric gears engaging with one another such as to obtain a differentiated needle speed with a motor M1 rotating at a constant speed. However, this same arrangement could also be used with a motor M1 that does not rotate at a constant speed and still obtain a speed profile according to the invention, the arrangement in particular permitting a number of speed profiles to be obtained.

According to another different embodiment shown in FIG. 9, at least one oval or elliptical pulley may be provided, particularly as shown, two elliptical pulleys 23, 24 and a belt 25 for the transmission between the motor M1 and one of the connecting rods of the module shown in FIG. 3, said elliptical pulleys and belt making it possible to obtain a differentiated needle speed with a motor M1 rotating at a constant speed. However, this same arrangement could also be used with a motor M1 that does not rotate at a constant speed and still obtain a speed profile according to the invention, the arrangement in particular permitting a number of speed profiles to be obtained.

According to yet another embodiment shown in FIG. 10, a so-called 'Maltese cross' transmission may be provided for the transmission between the motor M1 and at least one of the connecting rods of the module shown in FIG. 3, comprising a disc 26 driven in rotation around its central axis by the motor M1 and comprising a lug 27 that protrudes from the disc at a distance from the centre and which engages with a rotating element 28 in the form of a Maltese cross comprising, alternating along its periphery, sections 29 in the shape of arcs of a circle and rectangular slits 30, said lug engaging, as it rotates, alternately with the arcs of a circle and the slits to thus obtain a differentiated speed for the needles with a motor M1 rotating at a constant speed, the speed profile being a function of the relative shapes and positions of the arcs and slits. However, this same arrangement could also be used with a motor M1 that does not rotate at a constant speed and still obtain a speed profile according to the invention, the arrangement in particular permitting a number of speed profiles to be obtained.

Figure 2:
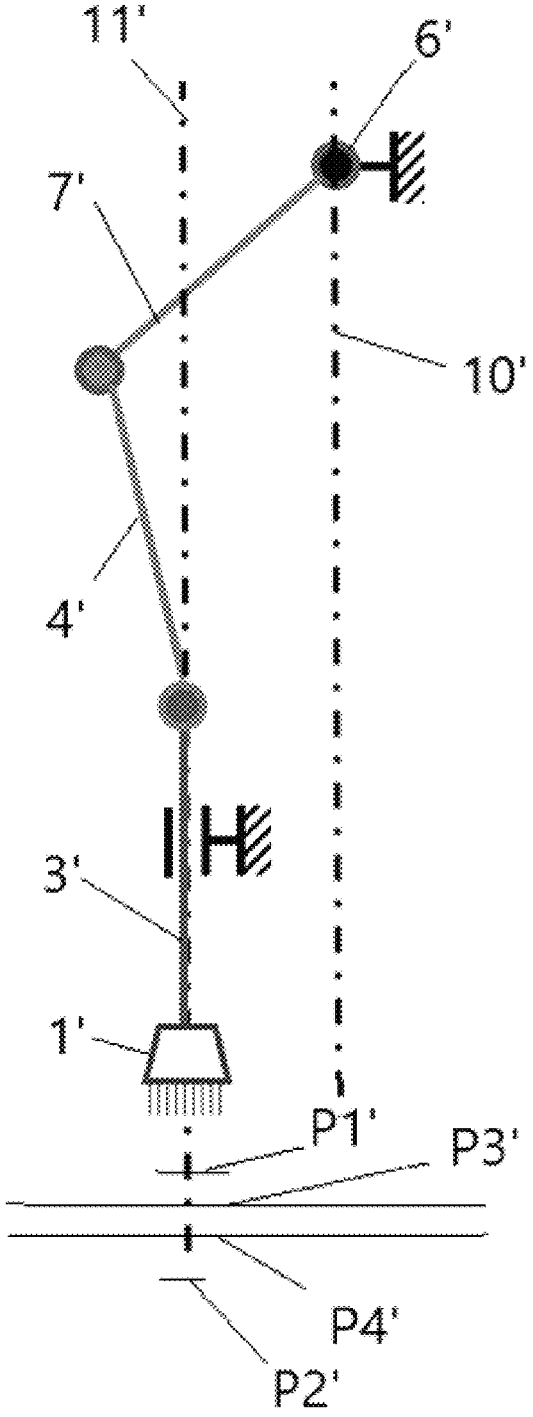
FIG. 2 is a schematic representation of a needle loom according to another embodiment of the invention.

FIG. 2 shows another embodiment of a needle loom according to the invention.

The connecting rod 7' of a crankshaft 6' is mounted such that it is hinged to a tie rod 4', which is itself mounted such that it is hinged to a column 3' forming an integral part of a needle board or beam 1'. The axis 10' of rotation of the crankshaft is offset, in the direction MD, with respect to the direction 11' of back-and-forth displacement of the column 3', this offset being reflected by a slower needle descent time than the needle raising time, to thus achieve a curve as shown on FIGS. 4 to 6 over a 360° rotation cycle.

The range of travel of the ends of the needles passes between the upper P'1 and lower P'2 end points, said points being where the ends of the needles change direction and thus have a zero speed. The median point P'0 is located halfway between the two points P'1 and P'2.

The lap or web to be consolidated extends between the two points P'3 and P'4 corresponding to the upper and lower outer surfaces of the web or the lap. In particular, it is possible to have point P'4, which may be above the lower point P'2 or below the lower point P'2 or may be merged with said point.

The median point may be located outside the two points P'3 and P'4, or inside the two points P'3 and P'4, in particular strictly inside the interval [P'3; P'4].

In particular, a support table may be provided with an upper surface that corresponds to point P'2 and a stripper pierced with holes through which the needles pass, and point P'1 is preferably located above the stripper to ensure that any fibre carried along by the needle when it moves back up is blocked by the stripper and remains below said stripper.

Another embodiment of the invention is shown in FIG. 3.

The assembly in FIG. 3 is a classic needle drive assembly using a crankshaft that drives two connecting rods that engage with one another to rotate in opposition to thus transmit a vertical movement to the needles. The crankshaft is driven by a motor M1, which is driven in rotation by rotation control means that cause its rotation speed to vary as a function of time to thus implement a needle speed profile according to the invention.

Figure 4:
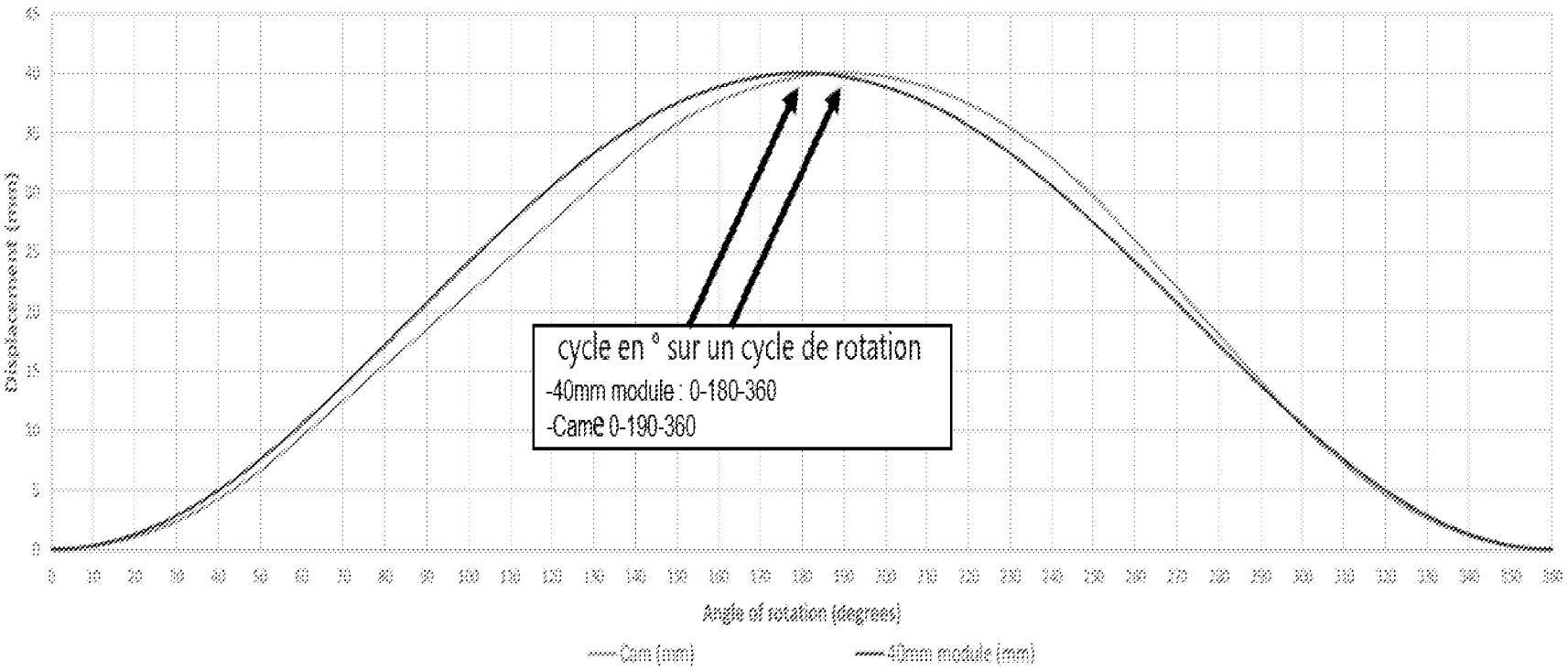
FIG. 4 is a graph showing, over a needle insertion-extraction cycle, on the one hand, an example of a curve showing the displacement of the needles as a function of the angle of rotation of the rotating element of the drive means for the needles of a needle loom according to the invention, particularly according to one of the embodiments in FIGS. 1 to 3, and, on the other hand, an example of a curve showing the displacement of the needles as a function of the angle of rotation of the rotating element of the drive means for the needles of a needle loom of the prior art (for example according to the embodiment in FIG. 3 with a constant rotation speed of the motor M1), both rotating elements of the needle loom according to the invention and according to the prior art respectively having the same constant rotation speed.

FIG. 4 shows, over a rotation cycle from 0° to 360° of the axis of rotation of the crankshaft motor in each of the embodiments shown in FIGS. 1 to 3, the displacement, measured in millimetres, in the vertical direction of the needles, and in the case of a crankshaft drive system of the prior art, which causes the needles to be driven symmetrically between the upwards and downwards strokes.

FIG. 4 shows that, for needle looms according to the invention, the bottom end of travel (40 mm towards the bottom, corresponding to the top of the 'sine' curve) occurs at an angle of 190°, 10° higher than in the case)(180° of needle looms of the prior art.

Thus, the needles descend (insertion into the lap or web of unwoven) over a 190° part of the cycle) (0°-190°, which is 10° bigger than the return part of the cycle (withdrawal of the needles)) (190°-360°, which is equal to 170°. This difference may be higher or lower, particularly ranging between 1° and 30°, preferably between 1° and 20°. In the case of needle looms of the prior art, this difference is zero or substantially zero (amounting to a few seconds of a degree, less than 1°).

In particular, a maximum speed of the end of the needles is reached, on the one hand when the needles descend and on the other hand when the needles go back up again, in the case of needles of the prior art, exactly at point P0 or median P'0, corresponding respectively to rotation angles of 90° and 270°, whereas, according to the invention, this maximum speed is reached during the descent cycle before the median point and then again, during the upward cycle, before the point, corresponding respectively to angles of rotation of 80° and 260°. This means that the maximum speed of the ends of the needles is reached in interval]P1; P0[when the needles descend and in interval]P2; P0[ when the needles go back up again. Thus, the speed profile in interval [P1; P0] has a maximum speed equal to that of the speed profile in interval [P2; P0] and the speed profile in interval [P0; P2] has a maximum speed less than those of the two profiles [P1; P0] and [P2; P0], and in this particular case here, equal to that of the profile of interval [P0; P1].

Figure 5:
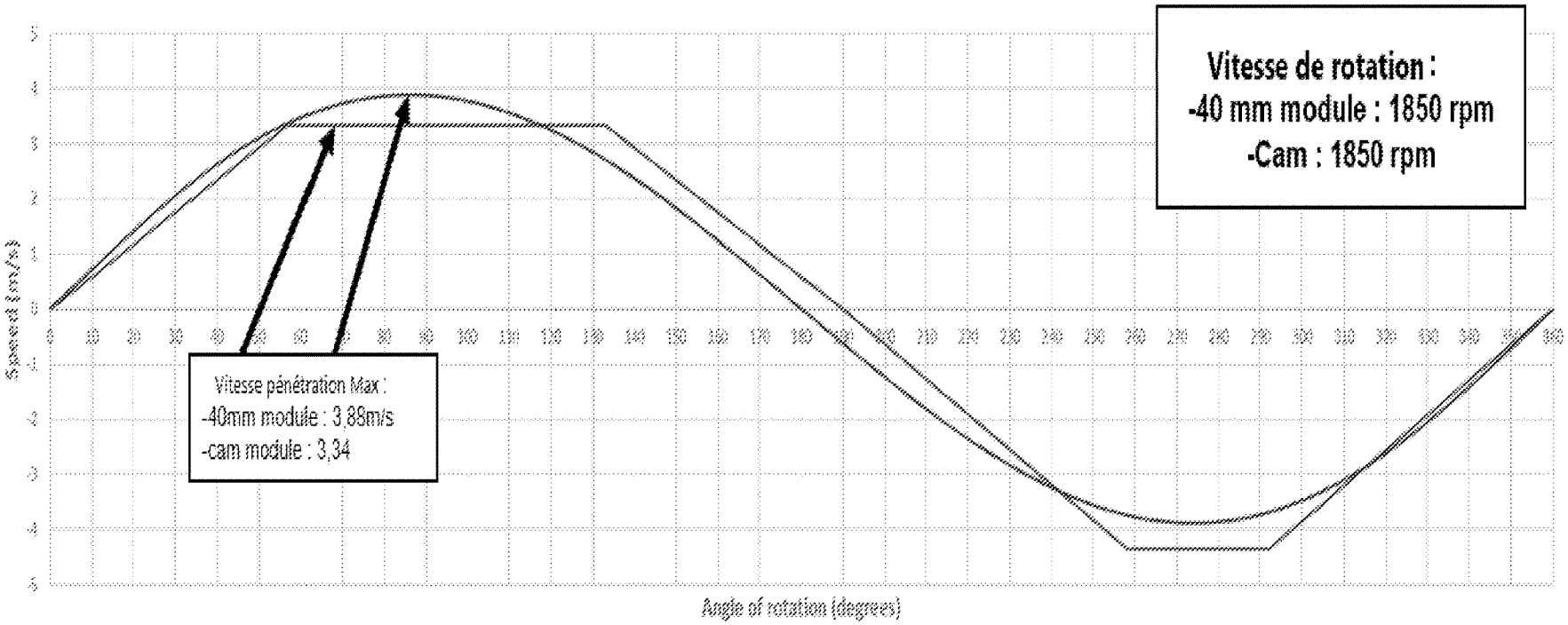
FIG. 5 is a graph showing, over a needle insertion-extraction cycle, on the one hand, an example of a curve for the speeds of the needles as a function of the angle of rotation of the rotating element of the drive means for the needles of a needle loom according to the invention, particularly according to one of the embodiments in FIGS. 1 to 3, and, on the other hand, an example of a curve for the speeds of the needles as a function of the angle of rotation of the rotating element of the drive means for the needles of a needle loom of the prior art (for example according to the embodiment in FIG. 3 with a constant rotation speed of the motor M1), both rotating elements of the needle loom according to the invention and according to the prior art respectively having the same constant rotation speed.
Figure 6:
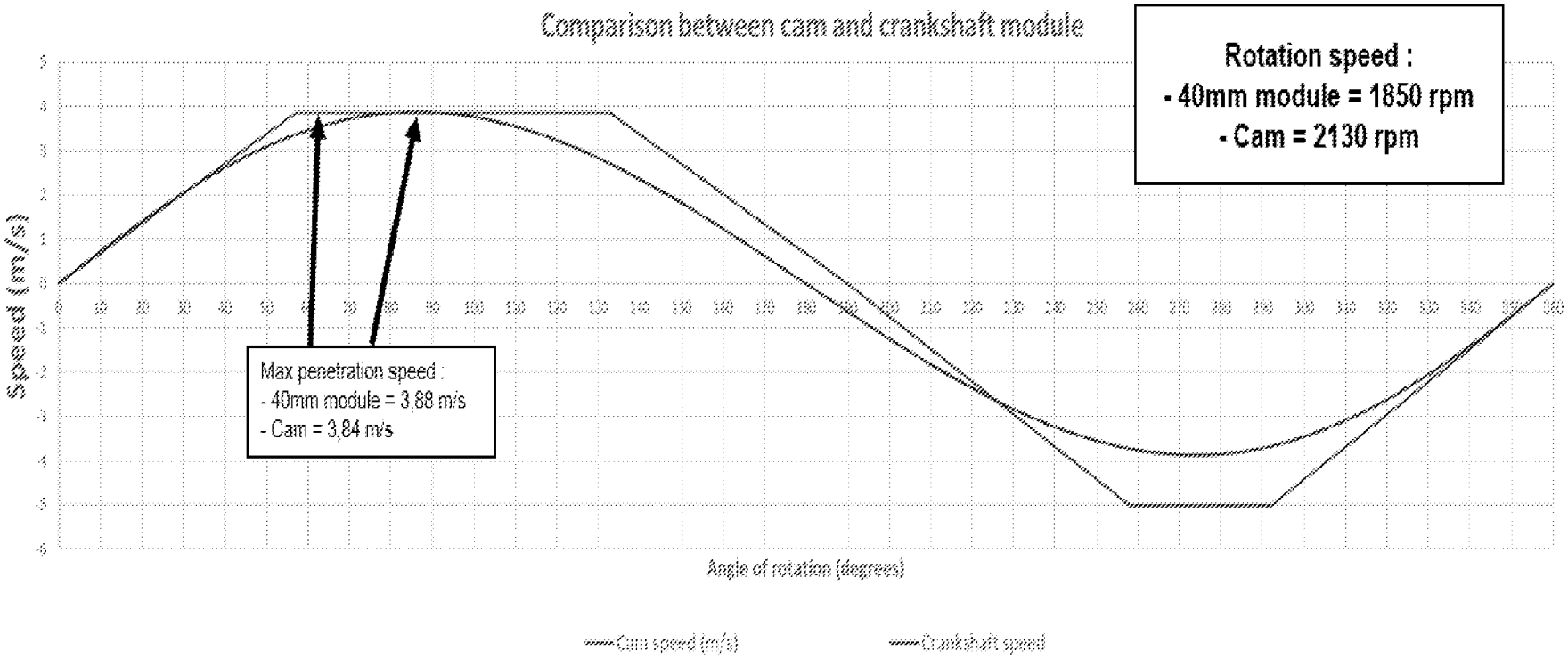
FIG. 6 is a graph showing, over a needle insertion-extraction cycle, on the one hand, an example of a curve for the speeds of the needles as a function of the angle of rotation of the rotating element of the drive means for the needles of a needle loom according to the invention, particularly according to one of the embodiments in FIGS. 1 to 3, and, on the other hand, an example of a curve for the speeds of the needles as a function of the angle of rotation of the rotating element of the drive means for the needles of a needle loom of the prior art, the rotating element of the needle loom according to the invention having a constant rotation speed that is higher (by 15%) than the speed of the rotating element of the needle loom of the prior art.

On the other hand, the arrangement of drive means for the needle loom may be selected such that the needle speed profile comprises a plateau on insertion and/or a plateau on extraction, as shown in FIGS. 5 and 6.

FIG. 5 shows the shape of the curve reflecting the speed of the needles during a rotation cycle of the drive crankshaft in the case of the needle loom from the invention, for example FIG. 1 and in the case of a needle loom of the prior art (for example as shown in FIG. 3 with a constant rotation speed for the motor MD, both crankshafts rotating at the same constant rotation speed, which gives the same speed as the nonwoven production line.

Thus, the speed profile of the needle loom from FIG. 1 comprises a first speed increase region up to an angle of approximately 57°, then a second region where the speed is constant, between 57° and approximately 133°, then a third region between 133° and 190° reducing to a zero speed.

For the needle extraction cycle, between 190° et 360°, the speed profile of the needle loom from FIG. 1 comprises a fourth speed increase region (as an absolute value) up to an angle of approximately 257°, then a fifth region where the speed is constant, between 257° and approximately 293°, then a sixth region between 293° and 360° reducing to a zero speed.

The speed on the plateau of the second region is less than the speed (as an absolute value) on the plateau in the fifth region. Furthermore, the plateau of the second region extends over a larger part of the cycle than the plateau in the fifth region, particularly between 1.5 and 3 times larger, more particularly between 2 and 2.5 times larger.

Thus, during extraction, the speed is higher and the speed profile is more abrupt than during insertion, whereas, in the case of the needle loom of the prior art, the speed profiles for insertion and extraction are symmetrical.

In FIG. 5, the constant rotation speed of the shaft of the crankshaft for both embodiments, as shown respectively in FIG. 1 and in the prior art (FIG. 3 with a constant rotation speed of the motor MD is identical, in this case equal to 1,850 rpm. At the same time, the speed of penetration in the second region is 14% lower than the maximum speed of the needle loom of the prior art, which means that the quality of the final product obtained after the needle loom is better, in particular with an improved appearance.

FIG. 6 shows the shape of the curve indicating the speed of the needles during a rotation cycle of the drive crankshaft in the case of the needle loom according to an embodiment of the invention, for example as shown in Fig, 1, and in the case of a needle loom of the prior art (for example according to the assembly in FIG. 3 with a motor M1 rotating at a constant speed), both crankshafts rotating at different rotation speeds, i.e. the crankshaft of the needle loom according to the invention rotating more quickly than the crankshaft of the needle of the prior art.

Thus, the speed profile of the needle loom according to the invention in FIG. 6 comprises a first speed increase region up to an angle of approximately 57°, then a second region where the speed is constant, between 57° and approximately 133°, then a third region between 133° and 190° slowing down to a zero speed.

For the needle extraction cycle, between 190° and 360°, the speed profile of the needle loom according to the invention in FIG. 6 comprises a fourth speed increase region up to an angle of approximately 257°, then a fifth region where the speed is constant, between 257° and approximately 293°, then a sixth region between 293° and 360° slowing down to a zero speed.

The speed on the plateau of the second region is lower than the speed on the plateau in the fifth region. Furthermore, the plateau of the second region extends over a larger part of the cycle than the plateau in the fifth region, particularly between 1.5 and 3 times larger, more particularly between 2 and 2.5 times larger.

Thus, during extraction, the speed is higher and the speed profile is more abrupt than during insertion, whereas, in the case of the needle loom of the prior art, the speed profiles for insertion and extraction are symmetrical.

In FIG. 6, the constant rotation speed of the shaft of the crankshaft of the embodiment in FIG. 3 is higher than that of the crankshaft of the prior art, namely 2,130 rpm in the case of the invention and 1,850 rpm in the case of the prior art.

At the same time, the speed of penetration in the second region is equal to the maximum speed of the needle loom of the prior art on insertion.

Thus, in FIGS. 5 and 6, the free ends of the needles have, in the first interval extending between the top end position P1 and the median position P0, a first movement having a first speed profile as an absolute value, then, in a second interval extending between the median position P0 and the other bottom end position P2, a second movement having a second speed profile as an absolute value, then, in a third interval extending between the bottom end position P2 and the median position P0, a third movement having a third speed profile as an absolute value, then, in a fourth interval extending between the median position P0 and the top end position P1, a fourth movement having a fourth speed profile as an absolute value, and the maximum speed of the second profile (i.e. the value of the speed in the first plateau) is less than at least one of the maximum speeds of the first, third and fourth profiles, i.e. the speed of the first plateau, the speed of the second plateau and the speed of the second plateau respectively.

Similarly, the duration of the first interval (from P1 to P0), which is proportional to the variation in angle, i.e. 95°, is equal to the duration of the second interval (from P0 to P2) and these two durations are longer than the duration of the third interval (from P2 to P0), which is proportional to the variation in angle, i.e. 85°, which is also equal to the duration of the fourth interval (from P0 to P1).

This results in a higher production rate for the same product quality, in particular for equally good nonwoven uniformity.

As can be seen on FIGS. 4 to 6, for embodiments according to the invention, the needle insertion duration (in the embodiments shown this relates to the descent speed, but, in another embodiment, it would also be possible to position the needles beneath the lap or web and perform the needle insertion movement by moving the needles upwards and then extracting downwards) is longer than the extraction duration, these durations, in FIGS. 4 to 6, being proportional to the angular extent of the descent (190°) and upwards) (170°) cycles.

FIG. 7 shows another example of speed profiles (as an absolute value) for the ends of the needles according to the invention.

Thus, in FIG. 7, the speed profile starts from a zero speed at P1 (when the needles are in one of the end positions, for example top, increasing rapidly to reach a plateau. Starting from a point upstream of point P0, the speed again reduces rapidly to a point downstream of point P0 to then remain constant until a point close to P2, upstream of the latter, the speed decreasing after this point until it reaches 0 at point P2. After P2, the speed (as an absolute value) increases again to reach a third plateau which is higher than the first plateau, which extends up to a point close to P1, upstream of the latter, before it then decreases rapidly to 0 at point P1, where the cycle then starts again.

The description above relates to embodiments for needle looms with rectilinear trajectories. However, without departing from the scope of protection of this application, it is possible to also apply the present invention to so-called elliptical needle looms, in which the needle trajectory takes the form of a non-rectilinear loop, particularly elliptical or substantially elliptical in shape, particularly a shape having two elliptical half-curves, each with a different eccentricity (due to the different speeds between the insertion movement and the extraction movement).

In the present description, it is intended that the word "vertical" or "vertical direction" means the direction extending perpendicularly to the plane of the web or lap, that is the direction perpendicular to both the MD direction (Machine Direction) and CD direction (Cross Direction).

The invention claimed is:

1. An assembly forming a needle loom comprising a web or lap of fibres that moves in a machine direction (MD), and a needle loom comprising one or more needle board(s) having a field of needles or respective field of needles arranged such as to penetrate the web or lap of fibres moving in front of the needles, said needle loom comprising drive means configured such as to induce a back-and-forth movement of the needles, in a displacement interval of free ends of the needles between two one top end position and one bottom end position where the free ends of the needles have a vertical speed component that is zero, such that the free ends of the needles have, in a first interval extending in the lap or web between an outer surface of the lap or web of fibres and an end position, a first movement having a first profile of speed vertical components in absolute value for a first duration, then, in a second interval extending in the lap or web between said one end position and said outer surface, a second movement having a second profile of speed vertical components in absolute value for a second duration, and the needles comprising barbs which, in the first interval, become attached to the fibres and move said fibres such that they become enmeshed with the other fibres, thus achieving consolidation, and, in the second interval, do not become attached to the fibres, characterised in that:

the maximum speed vertical component in absolute value of the second profile is higher than the maximum speed vertical component in absolute value of the first profile and/or the second duration is shorter than the first duration.

2. The assembly according to claim 1, characterised in that the free ends of the needles have, in a third interval, or preliminary interval, extending outside the lap or web between another end position and said outer surface of the web or lap, a third movement having a third profile of speed vertical components in absolute value for a third duration, and, in a fourth interval, or subsequent interval, extending outside the lap or web between said outer surface and said another end position, a fourth movement having a fourth profile of speed vertical components in absolute value for a fourth duration, and the maximum speed vertical component in absolute value of the first profile is less than at least one of the maximum speed vertical components in absolute value of the third and fourth profiles, and/or the first duration is longer than at least one of the third and fourth durations.

3. The assembly according to claim 2, characterised in that the maximum speed of the second profile is less than at least one of the maximum speeds of the third and fourth profiles and/or the second duration is longer than at least one of the third and fourth durations.

4. The assembly according to claim 1, characterised in that the drive means are configured such that the movement in the displacement interval in a direction between the two end positions in one direction takes place over an insertion duration, and in that the movement in the displacement interval between the two end positions in the opposite direction takes place over an extraction duration, and said insertion duration is longer than said extraction duration.

5. The assembly according to claim 4, characterised in that said insertion duration ranges between 1.01 and 5 times said extraction duration.

6. The assembly according to claim 4, characterised in that, during said insertion duration, the needles reach a maximum insertion speed vertical component in absolute value and, during said extraction duration, the needles reach a maximum extraction speed vertical component in absolute value, and the maximum extraction speed vertical component in absolute value is higher than the maximum insertion speed vertical component in absolute value.

7. The assembly according to claim 1, characterised in that the trajectory of the needles is rectilinear, perpendicular to a plane of the web or lap.

8. A method for operating a needle loom comprising at least one needle board in which:

a web or lap of fibres is moved in front of the needles in a machine direction, and the at least one needle board and/or the needles are driven in a back-and-forth movement in a direction other than the machine direction, such that free ends of the needles have, in a first interval extending in the lap or web between an outer surface of the web or lap of fibres and an end position, a first movement having a first profile of speed vertical components in absolute value for a first duration, then, in a second interval extending in the lap or web between said end position and said outer surface, a second movement having a second profile of speed vertical components in absolute value for a second duration, and the needles comprising barbs which, in the first interval, become hooked to the fibres and move said fibres such that they become enmeshed with the other fibres, thus achieving consolidation, and, in the second interval, do not become hooked to the fibres, characterised in that:

the maximum speed vertical component in absolute value of the second profile is higher than the maximum speed vertical component in absolute value of the first profile and/or the second duration is shorter than the first duration.

9. The method according to claim 8, characterised in that the free ends of the needles have, in a third interval, or preliminary interval, extending outside the lap or web between another end position and said outer surface of the web or lap, a third movement having a third profile of speed vertical components in absolute value for a third duration, and, in a fourth interval, or subsequent interval, extending outside the lap or web between said outer surface and said another end position, a fourth movement having a fourth profile of speed vertical components in absolute value for a fourth duration, and the maximum speed vertical component in absolute value of the first profile is less than at least one of the maximum speed vertical components in absolute value of the third and fourth profiles and/or the first duration is longer than at least one of the third and fourth durations.

10. The method according to claim 9, characterised in that the maximum speed of the second profile is less than at least one of the maximum speeds of the third and fourth profiles and/or the second duration is longer than at least one of the third and fourth durations.

11. The method according to claim 8, characterised in that the drive means are configured such that the movement in the displacement interval in a direction between the two end positions in one direction takes place over an insertion duration, and in that the movement in the displacement interval between the two end positions in the opposite direction takes place over an extraction duration, and said insertion duration is longer than said extraction duration.

12. The method according to claim 11, characterised in that said insertion duration ranges between 1.01 and 5 times said extraction duration.

13. The method according to claim 8, characterised in that, during an insertion duration, the needles reach a maximum insertion speed vertical component in absolute value and, during an extraction duration, the needles reach a maximum extraction speed vertical component in absolute value, and the maximum extraction speed vertical component in absolute value is higher than the maximum insertion speed vertical component in absolute value.

14. The method according to claim 8, characterised in that the trajectory of the needles is rectilinear, perpendicular to a plane of the web or lap.

15. A needle loom comprising one or more needle board (s) having a field of needles or respective field of needles arranged such as to penetrate a web or lap of fibres moving in a machine direction, in front of the needles, said needle loom comprising drive means configured such as to induce a back-and-forth movement of the needles, in a displacement interval of free ends of the needles between one top end position and one bottom end position where the free ends of the needles have a zero speed, such that the free ends of the needles have, in a first outward interval extending between a median position, being median between said top end and bottom end positions, and an end position, a first movement having a first outward profile of speed vertical components in absolute value for a first outward duration, then, in a second return interval extending between said end position and said median position, a second return movement having a second return profile of speed vertical components in absolute value for a second return duration, characterised in that:

the maximum speed vertical component in absolute value of the second return profile is different from the maximum speed vertical component in absolute value of the first outward profile, and/or the second return duration is different from the first outward duration.

16. The needle loom according to claim 15, characterised in that the free ends of the needles have, in a third outward interval extending between another end position and the median position, a third outward movement having a profile of speed vertical components in absolute value for a third outward interval, and, in a fourth return interval extending between said median position and said another end position, a fourth return movement having a profile of speed vertical components in absolute value for a fourth return duration, and the maximum speed vertical component in absolute value of the first profile is different from at least one of the maximum speed vertical components in absolute value of the third and fourth profiles and/or the first duration is different from at least one of the third and fourth durations.

17. The needle loom according to claim 16, characterised in that the maximum speed vertical component in absolute value of the second profile is different from at least one of the maximum speed vertical components in absolute value of the third and fourth profiles and/or the second duration is different from at least one of the third and fourth durations.

18. The needle loom according to claim 15, characterised in that the drive means are configured such that the movement in the displacement interval in a direction between the two end positions in one direction takes place over an insertion duration, and in that the movement in the displacement interval between the two end positions in the opposite direction takes place over an extraction duration, and said insertion duration is longer than said extraction duration.

19. The needle loom according to claim 18, characterised in that said insertion duration ranges between 1.01 and 5 times said extraction duration.

20. The needle loom according to claim 18, characterised in that, during said insertion duration, the needles reach a maximum insertion speed vertical component in absolute value and, during said extraction duration, the needles reach a maximum extraction speed vertical component in absolute value, and the maximum extraction speed vertical component in absolute value is higher than the maximum insertion speed vertical component in absolute value.

* * * * *